US006691353B2

(12) United States Patent
Fuhriman

(10) Patent No.: US 6,691,353 B2
(45) Date of Patent: Feb. 17, 2004

(54) ARM PILLOW

(76) Inventor: Richard Apollo Fuhriman, 13910 SE. 23 St., Bellevue, WA (US) 98005

( * ) Notice: Subject to any disclaimer, the term of this patent is extended or adjusted under 35 U.S.C. 154(b) by 0 days.

(21) Appl. No.: 10/078,586

(22) Filed: Feb. 20, 2002

(65) Prior Publication Data

US 2003/0014820 A1 Jan. 23, 2003

Related U.S. Application Data

(60) Provisional application No. 60/306,326, filed on Jul. 20, 2001.

(51) Int. Cl.[7] ..... A47G 9/00; A61F 5/00

(52) U.S. Cl. ..... 5/646; 5/632

(58) Field of Search ..... 5/646, 648, 630, 5/652, 655.9, 953

(56) References Cited

U.S. PATENT DOCUMENTS

| | | | | | |
|---|---|---|---|---|---|
| 1,973,240 | A | * | 9/1934 | Werness et al. | 5/646 X |
| 2,782,427 | A | * | 2/1957 | Ericson | 5/646 X |
| D247,311 | S | * | 2/1978 | Carter | 5/646 X |
| 4,210,317 | A | * | 7/1980 | Spann et al. | 5/647 |
| 4,235,472 | A | * | 11/1980 | Sparks et al. | 5/646 X |
| 4,730,801 | A | * | 3/1988 | Cloward | 5/646 X |
| 4,782,827 | A | * | 11/1988 | Paratte | 5/648 X |
| 5,410,769 | A | * | 5/1995 | Waterman | 5/632 |
| 5,644,809 | A | * | 7/1997 | Olson | 5/636 |
| 6,179,756 | B1 | * | 1/2001 | Bertolucci et al. | 482/91 |
| 2003/0014820 | A1 | * | 1/2003 | Fuhriman | 5/646 |

* cited by examiner

*Primary Examiner*—Robert G. Santos
(74) *Attorney, Agent, or Firm*—Thompson E. Fehr

(57) ABSTRACT

A pillow having a unique shape with rounded cuts for placing between an individual's side and arm to provide support when positioned along the arm at the elbow. When the individual is lying on his or her side, the pillow provides for proper alignment of the shoulder, arm, scapula, and neck to relieve pressure on joints, nerves, muscles and skin. Its unique posturing permits the body to relax and rest more comfortably and also increase potential blood flow and nerve transmission throughout the arm and shoulder complex. It is beneficial to those who suffer from a variety of shoulder problems, arthritis and sports related injuries and fatigue in addition to those who are convalescent, bedridden, computer operators, overhead throwers, data entry personnel and anyone who uses their shoulder and arm for an extended period of time.

9 Claims, 2 Drawing Sheets

ARM PILLOW

This application claims benefit of Provisional Application Ser. No. 60/306,526 filed Jul. 20, 2001.

BACKGROUND OF THE INVENTION

1. Field of the Invention

This invention relates to a pillow used for therapeutic purposes and, more particularly to a pillow that is placed between the arm and side/torso of an individual to provide support with the intention of maintaining the individual's body in proper alignment.

2. Description of the Prior Art

Previous attempts have been made and patented in regard to devices and, in particular, to pillows used to provide support and align various parts of an individual's body. Generally, prior patents disclose pillows which are of such length that they are utilized all along the body of the user, rather than the concept of this invention wherein a body pillow with three concave impressions is specifically made to fit between the arm and torso/rib cage of the user. Examples of prior patents are as follows: U.S. Pat. No. 2,056,767 issued on Oct. 15, 1935 to William H. Blath discloses a back pad attachable to the body of a user so that it will be held in position whether the patient is lying in bed of sitting, and which will permit freedom of movement for the spinal column in either position of the wearer.

U.S. Pat. No. 3,795,018 issued on Mar. 5, 1974 to Charley H. Broaded discloses an adjustable bed having a surface with supports of varying heights whereby the head, shoulders and legs are propped. When body members are propped up, the spine of the user is kept in linear alignment.

U.S. Pat. No. 4,173,048 issued on Nov. 6, 1979 to John A. Varaney discloses a pillow configuration having a central head supporting portion forming the top of the pillow and two extension portions positioned substantially perpendicularly to the central portion and extending substantially vertically downwardly therefrom, thus resulting in a pillow construction which provides sleeping comfort for the head and shoulders of the user.

U.S. Pat. No. 4,585,730 issued on Apr. 29, 1986 to Eva Rajan discloses a device for stabilizing the pelvis by supporting the lumbar region of an individual. Additional attachments support the individual's hipbones.

U.S. Pat. No. 4,624,021 issued on Nov. 25, 1986 to Jean A. Hofstetter discloses a cushion-like support with a neck extending from the shoulder area to the pelvis to bolster the torso of the user, thereby allowing the pressure points in the lower extremities of the user to be relieved.

U.S. Pat. No. 4,754,510 issued on Jul. 5, 1988 to Harry A. King discloses a body pillow for enhancing sleep or rest which is constructed and arranged to cushion and enfold the entire length of the body while providing a comfortable cushioned separation of the arms and legs of the user.

None of these patents, either taken singly or in combination, disclose the unique construction of the instant invention.

SUMMARY OF THE INVENTION

Accordingly, it is an object, advantage, and feature of the invention to provide a pillow, having three distinct concave openings, which can be used for therapeutic purposes.

It is another object, advantage, and feature of the invention to provide a supporting device which, when positioned from along the mid-upper arm to the hand, while on top of the rib cage or side of the individual provides a level of separation of the arm to a satisfactory level so that the arm remains in proper alignment as the individual sleeps.

It is another object, advantage, and feature of the invention to provide a device to relieve pain and pressure on muscles, joints and nerves so that an individual can relax and rest comfortably.

It is another object, advantage, and feature of the invention to provide an arm spacing pillow that can be used by either the right or left arm.

It is another object, advantage, and feature of the invention to provide a pillow having a compact construction, yet having all of the above noted features and being easily transportable for use at various locations.

It is another object, advantage, and feature of the invention to provide a pillow that can provide comfort to those who suffer from carpal tunnel syndrome, thoracic outlet syndrome and other repetitive stress disorders of the neck, shoulder, elbow, wrist and hand, for pre- and post-surgery recovery, shoulder degeneration, neck strain, muscular disorders, car accident and other trauma victims, pinched nerves, pulled muscles, anyone interested in proper body positioning and good health, insomniacs, as well as baseball, softball, football throwers and racquet sport participants and others who use their shoulder repetitively in competition or for recreation by facilitating post-exercise recovery.

These, and other object, advantages, and features of the invention will become apparent from the following description, drawings and claims.

DETAILED DESCRIPTION OF THE INVENTION

Figure 1:
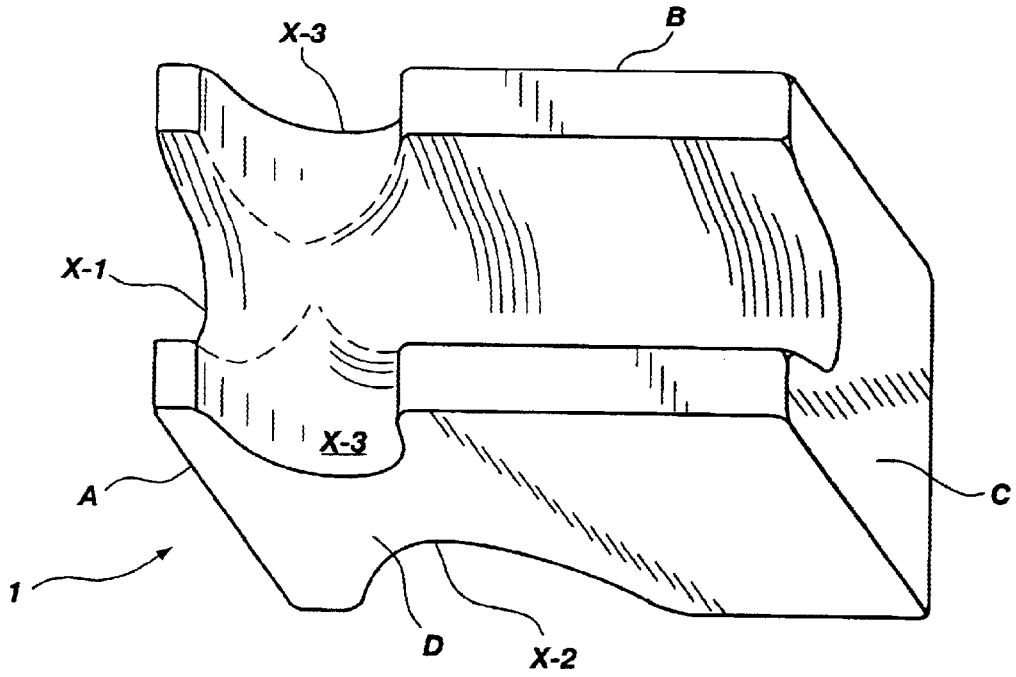
FIG. 1 shows a superior view of the device with the longer depressed portion being the part where the forearm would be placed with the smaller concavity being the part where the upper arm is supported.
Figure 2:
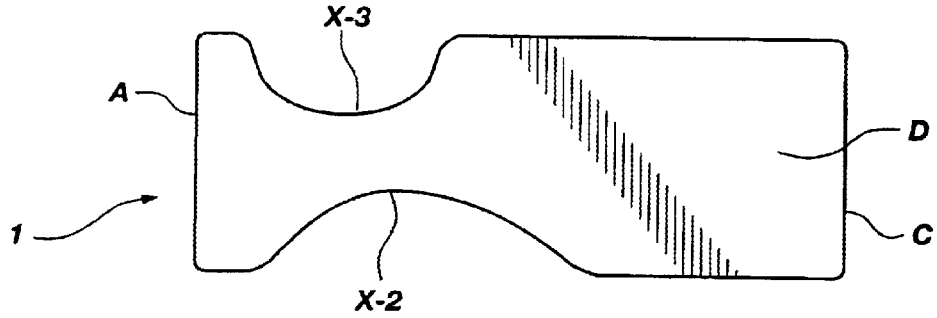
FIG. 2 is a side view of side D of the device showing the type of concave indentations into the foam necessary for the desired positioning of the arm, with the slightly elongated concavity being on the portion of the foam that rests on the side or rib cage of the individual.
Figure 3:
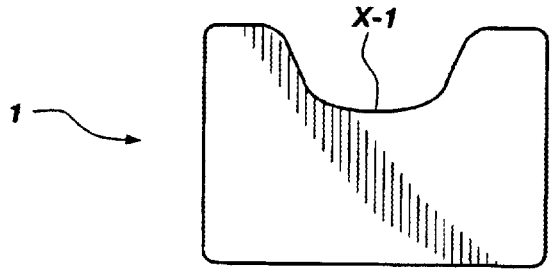
FIG. 3 is a view of the device from side A or C looking down from where the fingers and hand would be or at the portion where the elbow would rest.
Figure 4:
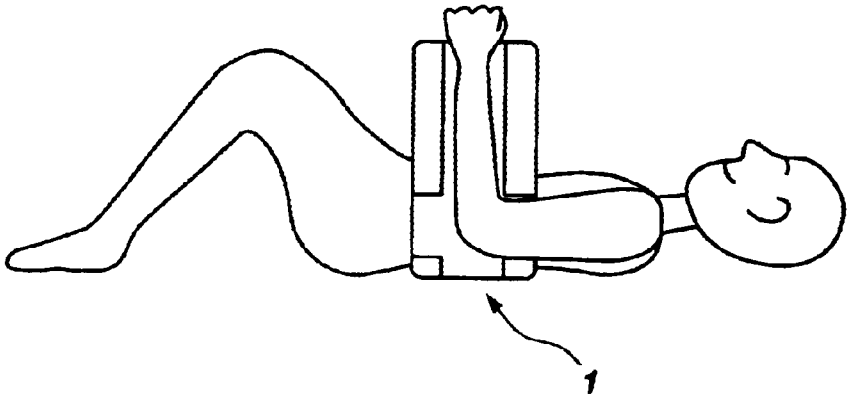
FIG. 4 is an overhead view of how the device is placed between the arm and body of an individual.
Figure 5:
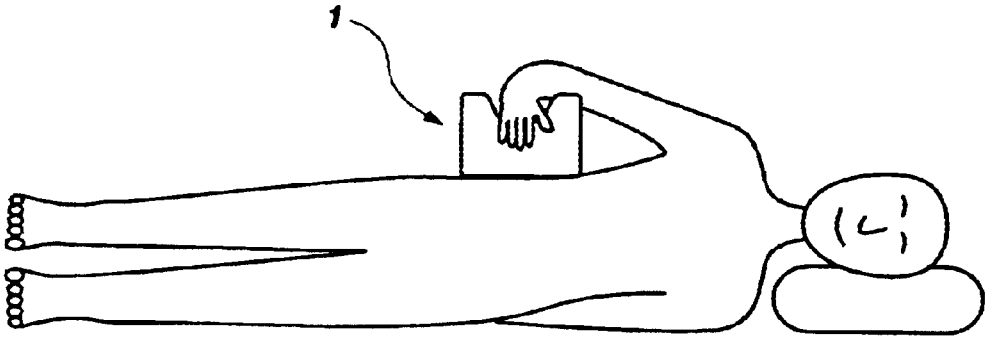
FIG. 5 is a straight-on view of an individual using the device while lying on his side.

This device is made out of pliant foam material (including slow-release density foam, also known as memory foam, or other soft foam as typically used for cushions) by cutting, shaping, laminating or molding the three concave indentions as mentioned in the description of the drawings. The device is made to conform to the varying size of individuals ranging from the smallest percentile (1–10$^{th}$ percentile of the population) requiring a much shorter and thinner total piece of foam as well as smaller concave cuts to hold the arm in place to a much larger, thicker and longer piece of foam for the larger (90–99$^{th}$ percentile of the population). For example, with the 89$^{th}$ percentile of the population of the USA, the device measures 18 inches in length, 6 inches in height and 9 inches in depth. The concavities for the $89^{th}$ percentile of the population are each (X-1, X-2, X-3) of a depth of two inches, with the top portion (X-1, X-3—where the arm is placed for the treatment) having a width of five inches at each concavity. The concavities are symmetrical in depth and width (but not length) and run the length and width of the device. The bottom portion (X-2—the part that rests on the rib cage) tapers slightly towards the hand end and also has a depth of cut of 2 inches, but it is 7 inches in width. For the $11^{th}$ percentile of the population, the device measures 14 inches in length, 4 inches in height and 5.5 inches in depth. The concavities for the $11^{th}$ percentile of the population are 1.25 inches in depth with the top portion (X-1, X-3) having a width of 3.5 inches at each concavity. The bottom portion (X-2—the part that rests on the rib cage) tapers slightly towards the hand end and also has a depth of cut of 1.25 inches, but it is 4.5 inches in width. Continuing with a specific example, for the 50th percentile of the population, the device measures 16 inches in length, 5 inches in height and 5.25 inches in depth. The concavities (X-1, X-2, X-3) for the 50th percentile of the population are each of a depth of 1.75 inches, with the top portion (where the arm is placed for the treatment) having a width of 4.25 inches at each concavity. The concavities (X-1 & X-3) are symmetrical in depth and width and run the length and width of the device. The bottom portion (concave X-2—the part that rests on the rib cage) tapers slightly towards the hand end and also has a depth of cut of 1.75 inches, but the length of the concavity is 5.75 inches in width. This device can be custom fitted to meet the criteria of the individual along the baselines presented here.

For convenience, side C is termed the hand end; side A, the side opposite to the hand end, is termed the elbow end; side B is termed the first lateral side; and side D is termed the second lateral side.

The longer concave indentation (X-1) and the shorter concave indentation (X-3) in the top of the pliant foam block (1) are designated as being "coplanar" since they both have, within the standards of one of ordinary skill in the field, the same depth (which shall, for convenience, be termed substantially the same depth) from the top of the block (1). The longer concave indentation (X-1) and the shorter concave indentation (X-3) are preferably substantially perpendicular to one another, i.e., such concave indentation (X-1, X-3) are sufficiently close to being perpendicular to one another that one of ordinary skill in the field would consider them to be perpendicular to one another. And the intersection of the longer concave indentation (X-1) and the shorter concave indentation (X-3) lies completely within the area bounded by the elbow end (A), the hand end (C), the first lateral side (B), and the second lateral side (D).

What is claimed is:

1. An arm pillow, which comprises:

a pliant foam block having an elbow end, a hand end, a first lateral side, a second lateral side, a top, and a bottom with a longer concave indentation running from the elbow end to the hand end in the top of said block, a shorter concave indentation running from the first lateral side to the second lateral side of said block in the top of said block, with the longer concave indentation and the shorter concave indentation being of substantially the same depth, with the longer concave indentation and the shorter concave indentation intersecting each other in such a manner that such intersection lies completely within the area bounded by the elbow end, the hand end, the first lateral side, and the second lateral side, said block further containing an elongated concave indentation on the bottom of said block with such elongated concave indentation running from the first lateral side to the second lateral side of said block.

2. The arm pillow as recited in claim 1, wherein:

the elongated concave indentation tapers as it nears the hand end of said block.

3. The arm pillow as recited in claim 2, wherein:

the longer concave indentation is substantially perpendicular to the shorter concave indentation.

4. The arm pillow as recited in claim 3, wherein:

the distance between the elongated concave indentation and the other concave indentations is selected to assure proper alignment of an arm inserted into such other concave indentations when the elongated concave indentation is placed adjacent to the side of the rib cage of a user.

5. The arm pillow as recited in claim 2, wherein:

the distance between the elongated concave indentation and the other concave indentations is selected to assure proper alignment of an arm inserted into such other concave indentations when the elongated concave indentation is placed adjacent to the side of the rib cage of a user.

6. The arm pillow as recited in claim 1, wherein:

the longer concave indentation is substantially perpendicular to the shorter concave indentation.

7. The arm pillow as recited in claim 6, wherein:

the distance between the elongated concave indentation and the other concave indentations is selected to assure proper alignment of an arm inserted into such other concave indentations when the elongated concave indentation is placed adjacent to the side of the rib cage of a user.

8. The arm pillow as recited in claim 1, wherein:

the distance between the elongated concave indentation and the other concave indentations is selected to assure proper alignment of an arm inserted into such other concave indentations when the elongated concave indentation is placed adjacent to the side of the rib cage of a user.

9. An arm pillow, which comprises:

a pliant foam block having an elbow end, a hand end, a first lateral side, a second lateral side, a top, and a bottom with a longer concave indentation running from the elbow end to the hand end in the top of said block, a shorter concave indentation running substantially perpendicular to the longer concave indentation from the first lateral side to the second lateral side of said block in the top of said block, with the longer concave indentation and the shorter concave indentation being of substantially the same depth, with the longer concave indentation and the shorter concave indentation intersecting each other in such a manner that such intersection lies completely within the area bounded by the elbow end, the hand end, the first lateral side, and the second lateral side, said block further containing an elongated concave indentation on the bottom of said block with such elongated concave indentation running from the first lateral side to the second lateral side of said block and tapering as such elongated concave indentation nears the hand end of said block wherein the distance between the elongated concave indentation and the other concave indentations is selected to assure proper alignment of an arm inserted into such other concave indentations when the elongated concave indentation is placed adjacent to the side of the rib cage of a user.

* * * * *